US006741815B1

(12) United States Patent
Fujita et al.

(10) Patent No.: US 6,741,815 B1
(45) Date of Patent: May 25, 2004

(54) IMAGE FORMING APPARATUS WITH FUNCTION OF COOLING SHEET

(75) Inventors: Keiko Fujita, Chiba (JP); Hajime Sekiguchi, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/404,660

(22) Filed: Apr. 2, 2003

(30) Foreign Application Priority Data

Apr. 8, 2002 (JP) ..... 2002-104744

(51) Int. Cl.[7] ..... G03G 15/00
(52) U.S. Cl. ..... 399/45; 399/401
(58) Field of Search ..... 399/45, 94, 405, 399/407, 401

(56) References Cited

U.S. PATENT DOCUMENTS 6,545,255 B2 4/2003 Sato et al. ..... 219/619

FOREIGN PATENT DOCUMENTS

| | | | |
|---|---|---|---|
| JP | 02-229040 | | 9/1990 |
| JP | 4-4260065 | * | 9/1992 |
| JP | 05-248837 | | 9/1993 |
| JP | 7-242370 | | 9/1995 |
| JP | 8-83009 | * | 3/1996 |
| JP | 9-281830 | * | 10/1997 |

* cited by examiner

*Primary Examiner*—Quana M. Grainger
(74) *Attorney, Agent, or Firm*—Fitzpatrick, Cella, Harper & Scinto

(57) ABSTRACT

An image forming apparatus having an image forming portion for forming an image on copy paper fed thereto, a fixing portion for heating and fixing the image formed on the copy paper by the image forming portion, a transporting portion for transporting the copy paper on which the image has been fixed by the fixing portion, at least one heat absorbing portion provided in the transporting portion for contacting with the copy paper and absorbing the heat of the copy paper, and at least one cooling portion for cooling heat absorbing portion.

10 Claims, 5 Drawing Sheets

IMAGE FORMING APPARATUS WITH FUNCTION OF COOLING SHEET

BACKGROUND OF THE INVENTION

1. Field of the Invention

The invention relates to an image forming apparatus such as a copying machine, a printer or a facsimile apparatus, and particularly to an electrophotographic image forming apparatus which can reverse the front side and the back side of copy paper on which an image has been fixed by heat and re-feed the copy paper to an image forming portion.

2. Description of Related Art

FIG. 7 of the accompanying drawings is a cross-sectional view of a digital copying machine as a conventional image forming apparatus.

A digital copying machine main body 1 is comprised of a reader 2 for reading the image of a document, and a printer 3 for forming an image on copy paper, and an auto document feeder 4 for successively feeding documents stacked thereon to a predetermined position on the reader 2 is connected to the reader 2.

A bundle of documents are stacked on the document stacker 401 of the auto document feeder 4 with the image surface of the head page facing upward, and are fed in succession from the uppermost document by the rotative driving of a document feed roller 402.

The thus fed document is placed on a document glass plate 201 with its image surface facing downwardly, and image reading by the reader 2 is effected. The image reading by the reader 2 is effected by a well-known technique of irradiating the document by an illuminating lamp 202, and imaging reflected light from the document on a CCD sensor in an image sensor 207 through the intermediary of reflecting mirrors 203, 204, 205 and a lens 206. As the reading operation at this time, there are two ways, i.e., the operation of reading with a scanner unit 208 comprising the illuminating lamp 202, the reflecting mirror 203, etc. moved relative to the documents stationarily placed on the document glass plate 201 (stationary document reading mode), and the operation of reading by the scanner unit 208 stationary relative to the document moving on the document glass plate 201 (flowing document reading mode), and the reading operation is selectively changed over in conformity with the mode, whereby the document reading time is shortened to thereby achieve an improvement in productivity. The documents of which the image reading by the reader 2 has been finished are successively delivered onto a document delivery tray 403 with their image surfaces facing downwardly.

A plurality of image data read by the above-described operation are all stored in a large-capacity memory (hard disc), not shown, and the image data stored in the memory are outputted to the printer 3 in the order conforming to an editing mode designated by the operating portion (not shown) of the digital copying machine 1.

Copy sheets which are recording mediums for the read images are contained in a right deck 301, a left deck 302, an upper cassette 303, a lower cassette 304 an a manual feed tray 305. The copy sheets successively fed one by one of feed rollers 306–310 being selectively rotatively driven are supplied to an image forming portion while being timed by registration rollers 311. In the image forming portion, a photosensitive drum 312 is rotated in the direction indicated by the arrow in FIG. 7 by a motor (not shown) and is charged to desired potential by a primary charger 313, and thereafter is subjected to the application of a predetermined laser beam based on image data, whereby an electrostatic latent image is formed on the photosensitive drum 312, and the electrostatic latent image is developed as a toner image by a developing device 315. As a developing process at this time, there is well known a triboelectrification process comprising agitating and conveying a magnetic toner stored in a developing device 315, attracting it to a rotary developing sleeve 317 on which a magnetic pole pattern (strength and weakness of a magnetic force) has been formed in the circumferential direction, thinly and uniformly regulating an amount of coat by a developing blade 318 of a magnetic material disposed with a uniform minute gap in the lengthwise direction of the developing sleeve and also, causing the toner to rub in an agitating portion and a minute gap portion to thereby impart predetermined charges thereto. The developed toner image is transferred to the supplied copy paper by a transfer charger 319, and the photosensitive drum 312 after the termination of the transfer has any residual toner thereon removed by a cleaner 320, and has any residual charges thereon eliminated by a pre-exposure lamp 321. The toner collected by the cleaner 320 is conveyed to a waste toner bottle (not shown) by a conveying portion such as a screw 322. The copy paper after the termination of the transfer is stripped from the photosensitive drum 312 by a stripping charger 323, is transported to a fixing roller 325 by a transport belt 324, and is subjected to pressure and heating by the fixing roller 325, whereby the toner image on the copy paper is fixed as a permanent image.

When a single-sided copy mode is selected by an operating portion (not shown), the copy paper on which the toner image has been fixed is delivered onto a delivery tray 331 by delivery rollers 330 via a straight delivery path 333.

On the other hand, when a two-sided copy mode is selected by the operating portion (not shown), the copy paper of which the toner image on the first side has been fixed is once drawn into a surface reverse portion 327 via a surface reverse transport path 326, and thereafter goes via a duplex transport path 332 by the reverse rotation of surface reverse rollers 328, whereby it is again supplied to the image forming portion with the upper side and the lower side of the copy paper reversed, and an image on the second side is formed. The copy paper of which the toner images on the two sides have been fixed goes via the straight delivery path 333 and is delivered onto the delivery tray 331 by the delivery rollers 330.

In the above-described image forming apparatus, however, when in the two-sided copy mode, there is a case where copy paper heated by the fixing roller is again supplied to the image forming portion in a state in which it is not sufficiently cooled, there has been the undesirable possibility that the toner in the developing device rises in temperature due to the heat radiation from the copy paper and the chargeability thereof is deteriorated and such abnormal image as thin image density occurs.

Also, in cases where, due to heat radiation from copy paper during two-sided copying, the toner in the developing device rises in temperature beyond a fusing point, there is the undesirable possibility that the fused toner is fused to the developing sleeve or the developing blade and the amount of toner coat on the developing sleeve becomes non-uniform and an abnormal image such as uneven image density or a streaked image occurs.

Further, in cases where the fuse toner is fused and bonds to a toner conveying member such as the agitator of the developer or the screw of the cleaner, there is also the undesirable possibility that the conveyance of the toner is hindered or faulty operation due to the rise of a driving load is caused.

Particularly, with the recent tendency toward higher speed image forming apparatus, the time from when copy paper has passed the fixing roller until it again arrives at the image forming portion becomes shorter, and the time for which the heat of duplex copy paper is diffused in a machine and cooled is decreased, and the quantity of heat imparted to the toner in the developing device and the cleaner per unit time tends to increase more and more.

In order to solve the problem of the temperature rise of the toner in the developing device and the cleaner attributable to the heat of the duplex copy paper, there have heretofore been proposed various techniques of disposing a copy paper cooling portion in a transport route downstream of a fixing roller.

As an example of them, as disclosed in Japanese Patent Application Laid-Open No. 7-242370, there is a technique of disposing a blower portion such as a fan downstream of a fixing roller, and directly blowing a cooling wind against duplex copy paper, but if the air flow rate of the fan is too strong, there may occur bad conveyance such as paper breakage, paper wrinkling or jam due to the fluttering of the copy paper, and the air flow rate of the fan is limited to such a level that the above-noted problems do not arise and therefore, the cooling capability thereof has been limited.

Also, as disclosed in Japanese Patent Application Laid-Open No. 4-46451, there is a technique of disposing a heat absorbing portion such as a heat pipe downstream of a fixing roller, contacting with duplex copy paper directly or through a conveying belt or a conveying guide to thereby effect heat absorption, and cooling a radiating portion disposed in a space independent of a paper transport area by a blower portion such as a fan, but the contact area of a heat transmitting portion is limited by the diameter of the heat pipe and therefore, the cooling capability thereof has been limited or the bulkiness of the apparatus has resulted.

SUMMARY OF THE INVENTION

An embodiment of the present invention has been made in view of the above-noted problem, and an object thereof is to provide an image forming apparatus which does not result in faulty transport or the bulkiness of the apparatus due to the fluttering of copy paper and which can sufficiently cool the heat of duplex copy paper without limiting the cooling capability of even an image forming apparatus in which higher speed requiring higher cooling capability has been realized or the fixing temperature has become high, and which can prevent a faulty image and a faulty operation due to the temperature rise of a toner in a developing device and a cleaner in a two-sided copy mode.

In order to achieve the above object, the image forming apparatus according to the present invention is an image forming apparatus having an image forming portion for forming an image on copy paper fed thereto, a fixing portion for heating and fixing the image formed on the copy paper by the image forming portion, and a transporting portion for transporting the copy paper on which the image has been fixed by the fixing portion, and is characterized in that in the transporting portion, there are disposed at least one heat absorbing portion for contacting with the copy paper and absorbing the heat of the copy paper, and at least one cooling portion for cooling the heat absorbing portion.

Other objects and features of the present invention will become apparent from the following description and the accompanying drawings.

DETAILED DESCRIPTION OF THE PREFERRED EMBODIMENTS

Embodiment 1

Figure 1A:
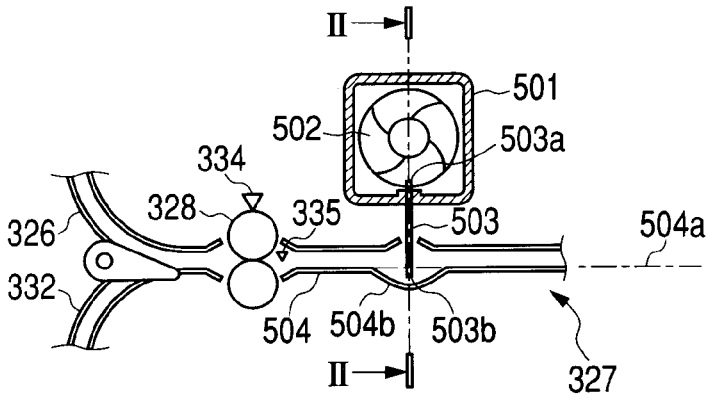
FIGS. 1A, 1B, 1C and 1D are cross-sectional views showing the surface reverse portion of an image forming apparatus according to Embodiment 1.

FIGS. 1A, 1B, 1C and 1D are cross-sectional views showing the surface reverse portion 327 of the image forming apparatus 1 of the present invention.

The basic construction and image forming process of the image forming apparatus 1 of the present invention are as described with respect to the example of the conventional art and therefore need not be described any further.

As shown in FIGS. 1A–1D, in the present invention, above the downstream side of the surface reverse rollers 328 in the example of the conventional art with respect to a forward rotation transport direction, there are additionally disposed a hollow duct 501, a blower fan 502 for blowing a predetermined air flow rate of cooling wind against the hollow portion of the duct 501, and a cut-sheet-shaped thin-walled member 503 fixed to the duct 501 in such a manner than the upper end 503*a* thereof protrudes to the hollow portion. The cut-sheet-shaped thin-walled member 503 can be, for example, one manufactured from a metal material such as aluminum, copper or silver into a thin film shape by a manufacturing method such as electroforming or spray forming, or one having good heat conductivity and flexibility like a sheet of silicon rubber or a graphite sheet formed by graphitizing high molecular film which a method of manufacturing is already disclosed in Japanese Patent Publication No. 1-49642, etc (hereinafter referred to as the good heat conductive sheet 503).

The good heat conductive sheet 503, as shown in FIG. 1A, is of a construction in which the lower end 503*b* thereof protrudes downwardly from the transport surface 504*a* of a lower guide 504, and the lower guide 504 in a portion opposed to the lower end 503*b* is formed with a depression shape 504*b* for avoiding the interference with the good heat conductive sheet 503.

Figure 2:
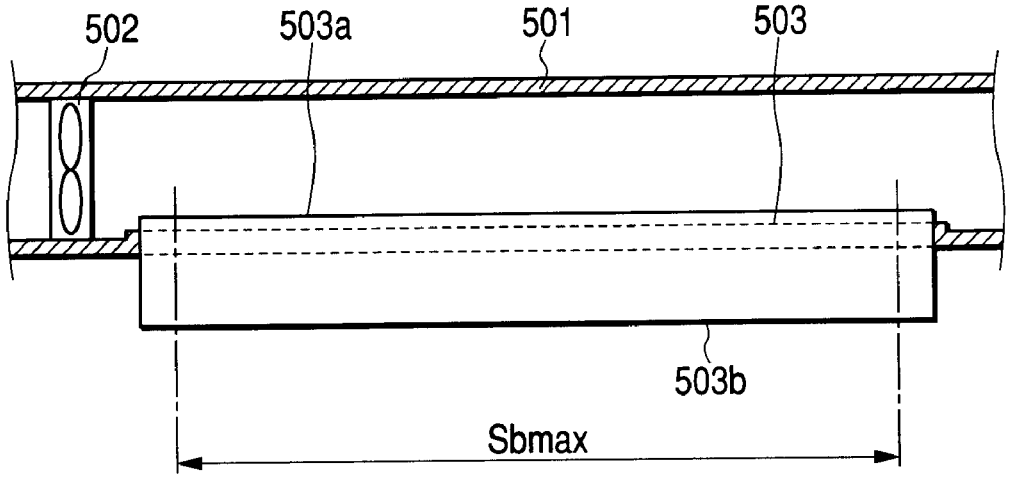
FIG. 2 is a cross-sectional view taken along line II—II of FIG. 1A and showing a copy paper cooling portion is Embodiment 1.

Also, as shown in the cross-sectional view of FIG. 2, the widthwise dimension of the good heat conductive sheet 503 is greater than the maximum width Sbmax of copy paper.

Figure 1B:
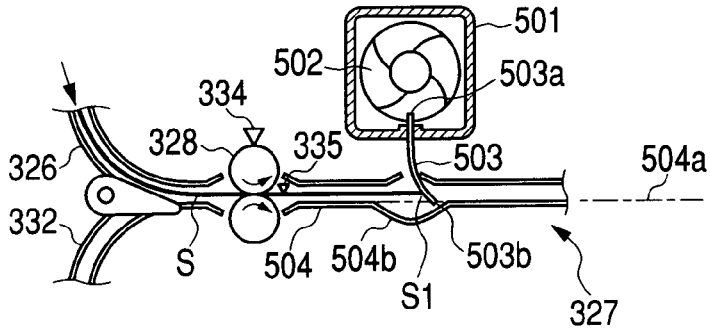
Figure 1C:
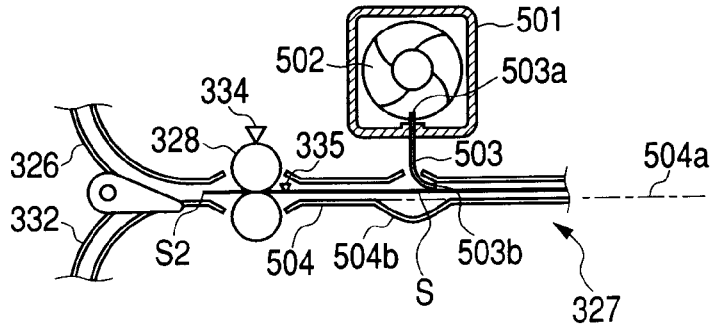
Figure 1D:
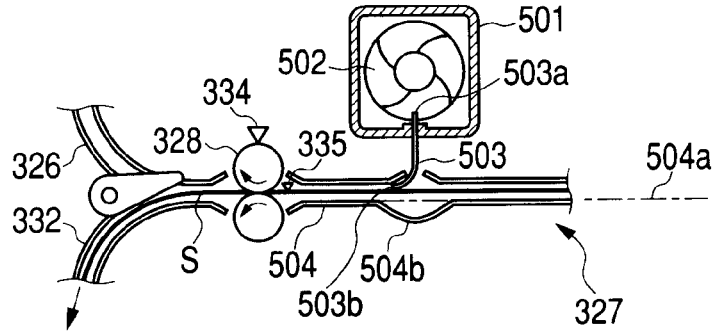

The good heat conductive sheet 503 is provided with such a degree of flexibility as will not hamper the transportability of the copy paper S, and when as shown in FIG. 1B, the copy paper S on which an image on a first side has been heat-fixed is transferred to a surface reverse portion 327 via a surface reverse transport path 326, the lower end 503*b* of the good heat conductive sheet can be easily flexed in a rightward direction as viewed in FIG. 1B by the leading edge S1 of the copy paper with respect to the forward rotation transport direction thereof. Thereafter, the forward rotation transport of the copy paper S is effected while contacting with and rubbing against the lower end 503*b* of the flexed good heat conductive sheet, and as shown in FIG. 1C, the forward rotation transport is terminated before the trailing edge S2 of the copy paper with respect to the forward rotation transport direction leaves the nip between surface reverse rollers 328. Next, when as shown in FIG. 1D, the surface reverse rollers 328 are reversely rotated, the lower end 503*b* of the good heat conductive sheet as viewed in FIG. 1D is easily flexed in the leftward direction as viewed in FIG. 1D, following the surface reverse transport direction of the copy paper S, and as during the forward rotation transport, the copy paper S is surface-reverse-transported while contacting with and rubbing against the lower end 503*b* of the flexed good heat conductive sheet. When the copy paper S is directed to a duplex path 332 and the trailing edge S1 of the copy paper in the surface reverse transport direction passes the good heat conductive sheet 503, the good heat conductive sheet 503 returns to its initial state shown in FIG. 1A.

Now, in the surface reversing operation of the copy paper S described above, the good heat conductive sheet 503 of the present invention absorbs heat from the copy paper S at the lower end (heat absorbing end) 503*b* thereof while it contacts with and rubs against the copy paper S, and receives a cooling wind from the blower fan 502 at the upper end (radiating end) 503*a* thereof and releases heat to the outside of the image forming apparatus 1.

Consequently, the copy paper S heated by a fixing device 325 is efficiently cooled through the good heat conductive sheet 503 in the surface reverse portion 327.

At this time, the wind from the blower fan 502 does not directly act on the copy paper S, but passes through only the interior of the duct 501 and therefore, there is no possibility of the wind hindering the transportability of the copy paper S.

Consequently, the air flow rate from the blower fan 502 is not limited, but a proper air flow rate conforming to the quantity of heat of the copy paper S can be secured and therefore, it becomes possible to sufficiently cool the heat imparted by the fixing roller 325, and thereafter again transport the copy paper S to the image forming portion, and even for an image forming apparatus 1 made higher in speed or an image forming apparatus 1 high in fixing temperature, it becomes possible to prevent a faulty image and a faulty operation due to the temperature rise of a toner in a developing device 315 and a cleaner 320 in a two-sided copy mode.

The position of a copy paper cooling portion comprising the duct 501, the blowing fan 502 and the good heat conductive sheet 503 of the present invention in the image forming apparatus is not restricted to the construction described in the present embodiment, but the copy paper cooling portion may be disposed at any other position within the range of a route leading from the fixing roller 325 again to the image forming portion, but when as in the present embodiment, it is disposed near the surface reverse rollers 328 of the surface reverse portion 327, cooling is effected at a position remote from the fixing roller 325 and there is not such an evil that the temperature of the fixing roller 325 is lowered by the cooling wind, and the copy paper S can be efficiently cooled without being effected by the heat from the fixing roller 325 and moreover, a wide range of area approximate to substantially the whole area of the copy paper S can be cooled twice before and after surface reversal and therefore, it becomes possible to cool the copy paper S more efficiently.

Also, the position of the copy paper cooling portion relative to the surface reverse rollers 328 is not restricted to the construction described in the present embodiment, but the copy paper cooling portion may be disposed upstream of the surface reverse rollers 328 in the forward rotation transport direction, but when as in the present embodiment, it is disposed near the downstream side of the surface reverse rollers 328, the leading edge S1 of the copy paper rushes into the good heat conductive sheet 503 in a state of a short free length in which the portion thereof immediately behind it is nipped between the surface reverse rollers 328 and therefore, it becomes difficult for the buckling of the copy paper S when it rushes in to occur, and it becomes possible to secure proper transportability even for thin paper lower in rigidity.

Also, the vertical position of the copy paper cooling portion relative to the transport route is not restricted to the construction described in the present embodiment, but the copy paper cooling portion may be disposed below the transport route, but when as in the present embodiment, it is disposed above the transport route so as to let heat escape upwardly, the effect of natural convection is added and it is possible to cool the copy paper S more efficiently. Also, the cooling portion may be disposed above and below the transport route, and in this case, the two sides of the copy paper S can be cooled and it becomes possible to cool the copy paper S still more efficiently.

The number of the disposed copy paper cooling portions is not restricted to the construction described in the present embodiment, but a plurality of copy paper cooling portions may be disposed side by side or there may be adopted a construction in which a plurality of good heat conductive sheets 503 are fixed to a single duct 501. In this case, the area of contact of the good heat conductive sheets 503 with the copy paper S is increased and it becomes possible to absorb a greater quantity of heat from the copy paper S within a short time, and it becomes possible to cool the copy paper S much more efficiently, and according to this process, the area of contact can be easily increased without the image forming apparatus 1 being made bulky.

Embodiment 2

Figure 3:
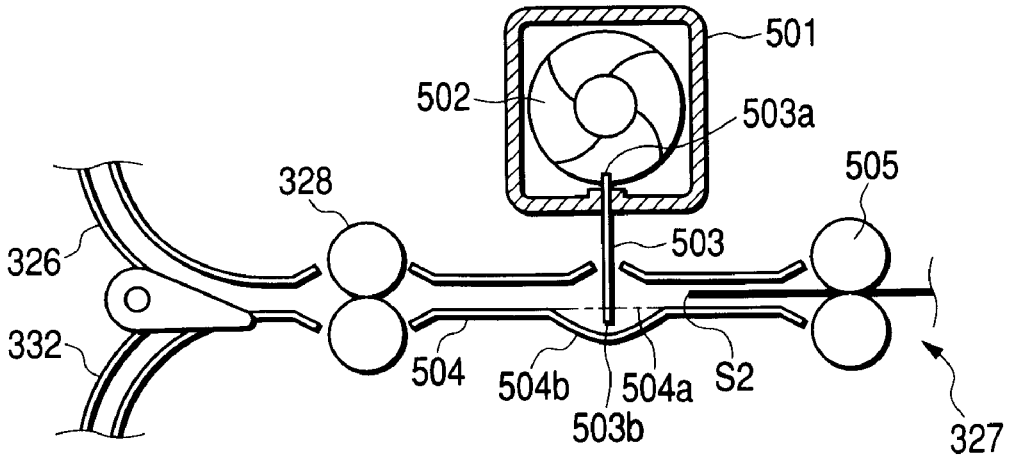
FIG. 3 is a cross-sectional view showing the surface reverse portion of an image forming apparatus according to Embodiment 2.

FIG. 3 shows an embodiment in which downstream of the surface reverse rollers (hereinafter referred to as the first surface reverse rollers) 328 described in Embodiment 1 during the forward rotation transport thereof, there are additionally disposed second surface reverse rollers 505 rotatively driven forwardly and reversely in synchronism with the first surface reverse rollers 328, and a copy paper cooling portion comprising a duct 501, a blower fan 502 and a god heat conductive sheet 503 is disposed between the first surface reverse rollers 328 and the second surface reverse rollers 505.

According to this construction, even if the stopped position of the trailing edge S2 of the copy paper during surface reverse is deviated from the position of the good heat conductive sheet 503 toward the downstream side in a forward rotation direction, it becomes possible to perform a proper surface reverse transporting operation by the second surface reverse rollers 505.

FIG. 3 shows the stopped state of the copy paper S during surface reverse, and by the stopped position of the copy paper during surface reverse being deviated as described above, an area in which the good heat conductive sheet 503 contacts with the copy paper S can be widened to the whole area of the copy paper S. Consequently, within a wider range than described in Embodiment 1, the whole area of the copy paper can be cooled twice, and it becomes possible to cool the copy paper S for more efficiently.

Embodiment 3

While in Embodiments 1 and 2, the good heat conductive sheet 503 is of the shape of a cut sheet, the present invention is not restricted thereto.

Figure 4:
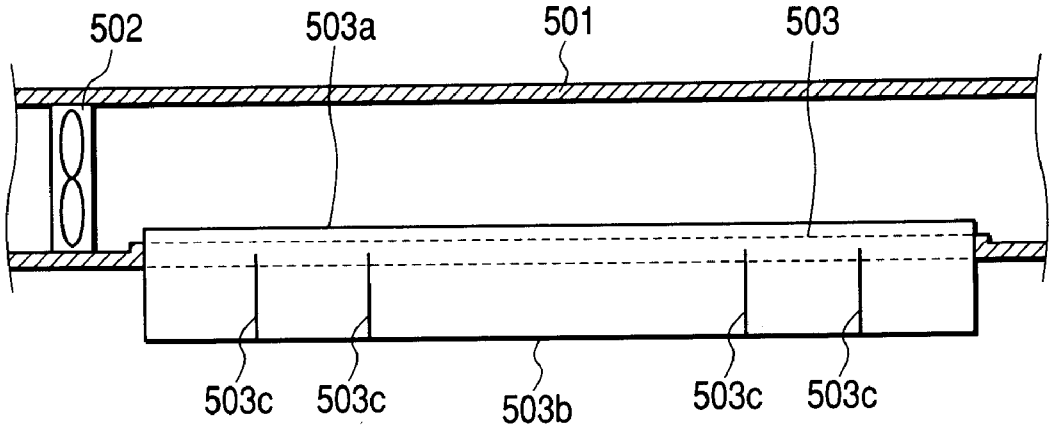
FIG. 4 is a cross-sectional view showing a copy paper cooling portion in Embodiment 3.

If as shown, for example in FIG. 4, there is adopted a construction in which the good heat conductive sheet 503 is formed with a plurality of slits 503*c* and is widthwisely divided, in the case of copy paper of a small size, the shock thereof during the rushing into the good heat conductive sheet 503 or the transport load by the rubbing thereof can be mitigated, and it becomes possible to effect the more stable transport of the copy paper S.

Embodiment 4

While in Embodiments 1 to 3 the good heat conductive sheet 503 is designed such that its direction of flexure is changed following the transported copy paper S, the present invention is not restricted thereto.

Figure 5A:
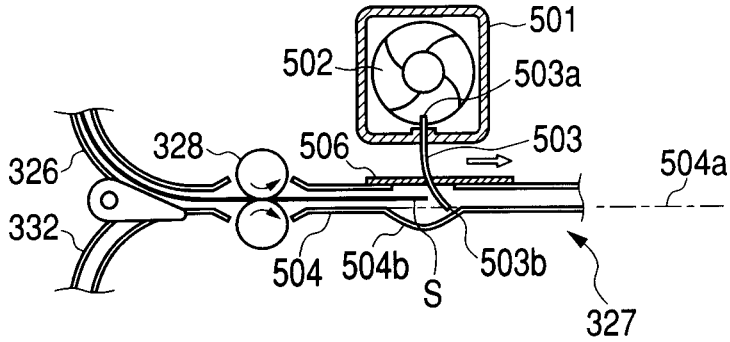
FIGS. 5A and 5B are cross-sectional views showing the surface reverse portion of an image forming apparatus according to Embodiment 4.
Figure 5B:
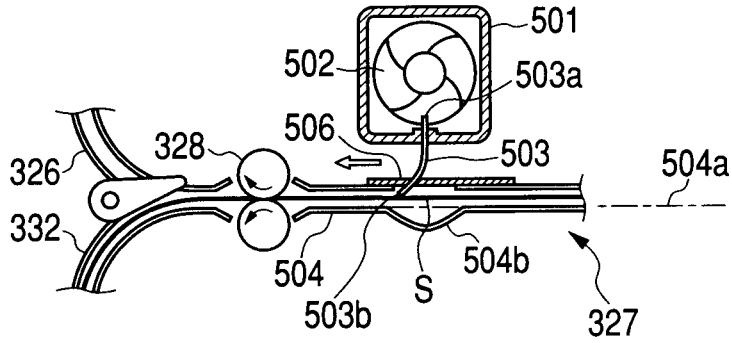

As shown, for example, in FIGS. 5A and 5B, a changeover plate 506 moved in the left to right direction and the right to left direction as viewed in FIGS. 5A and 5B in operative association with the forward and reverse rotation of the surface reverse rollers 328 to thereby change the direction of flexure of the good heat conductive sheet 503 may be disposed. If this construction is adopted, before the copy paper S rushes in, the good heat conductive heet 503 can be flexed to a certain extent and therefore, the shock and the transport load of the copy paper S occurring during the rushing-in of the copy paper S can be mitigated, and it becomes possible to effect the stabler transport of the copy paper S.

Embodiment 5

While in Embodiments 1 to 4 the good heat conductive thin-walled member is of the shape of a cut sheet, the present invention is not restricted thereto.

Figure 6:
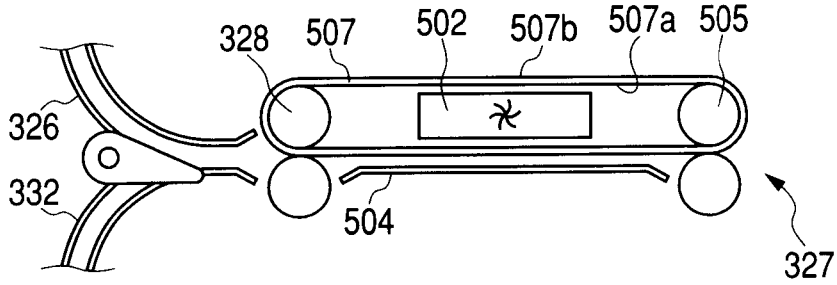
FIG. 6 is a cross-sectional view showing the surface reverse portion of an image forming apparatus according to Embodiment 5.
Figure 7:
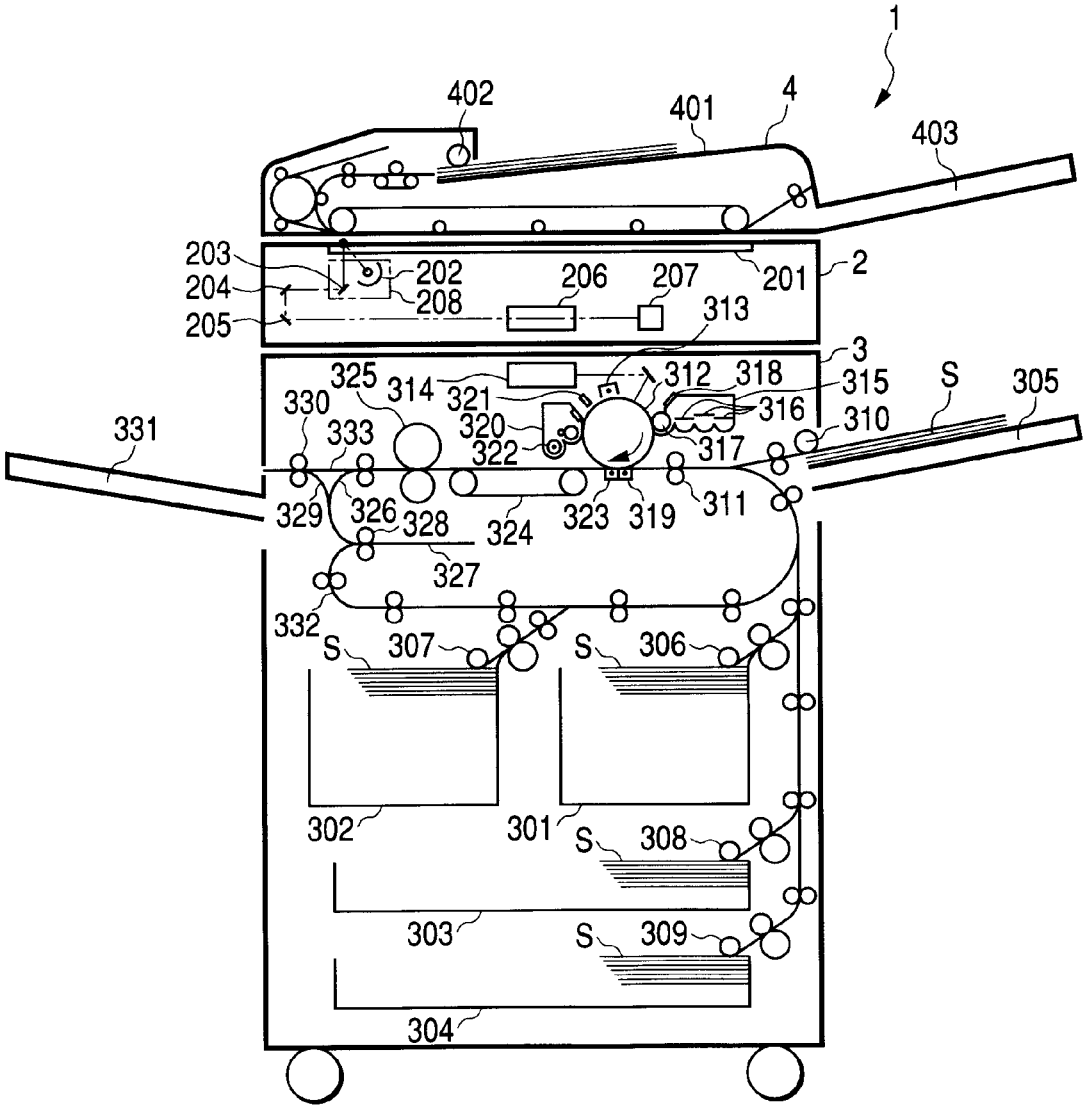
FIG. 7 is a cross-sectional view showing the surface reverse portion of an image forming apparatus according to the conventional art.

As shown, for example, in FIG. 6, the good heat conductive thin-walled member may be of an annular belt shape. An annular good heat conductive thin-walled member (hereinafter referred to as the good heat conductive belt) 507 is passed between the first surface reverse rollers 328 and the second surface reverse rollers 505, and contacts with the copy paper S by its outer peripheral surface 507*b* and absorbs heat, and receives the air flow from the blower fan 502 by its inner peripheral surface 507*a* and discharges the heat to the outside of the image forming apparatus 1.

According to this construction, the inner peripheral surface 507*a* of the good heat conductive belt provides a wind path and therefore, not only the duct 501 becomes unnecessary, but also the area of contact with the copy paper S can be enlarged and it becomes possible to cool the copy paper S still more efficiently.

Also, the good heat conductive belt 507 is driven by the surface reverse rollers 328 and 505 so that the speed of the outer peripheral surface 507*a* thereof may become the same as the transport speed of the copy paper S and therefore, the shock when the copy paper S rushes into the good heat conductive belt 507 and the rubbing during the contact between the copy paper S and the good heat conductive belt 507 become null, and the transport load is mitigated and it becomes possible to effect the much stabler transport of the copy paper S.

Even in the case of the good heat conductive belt 507 in the present embodiment, as in the case of the good heat conductive sheet 503 described in Embodiment 1, the position of the copy paper cooling portion in the image forming apparatus may be any other position within the range of a route leading from the fixing roller 325 again to the image forming portion, but when as described in the present embodiment, the copy paper cooling portion is disposed near the surface reverse rollers 328 of the surface reverse portion 327, as described in the present embodiment, it becomes possible to efficiently cool the copy paper twice before and after surface reversal without lowering the temperature of the fixing roller 325. Also, the vertical position of the copy paper cooling portion relative to the transport route may be below the transport route, but when as described in the present embodiment, it is disposed above the transport route, the effect of natural convection is added and it becomes possible to cool the copy paper S efficiently. Also, if the copy paper cooling portion is disposed above and below the transport route, the two sides of the copy paper can be cooled and not only it becomes possible to cool the copy paper S more efficiently, but also the transport load by the rubbing of the high heat conductive belt 507 against a lower guide 504 opposed thereto becomes null, and it becomes possible to effect the still stabler transport of the copy paper S.

Embodiment 6

While in Embodiments 1 to 5 the blowing fan 502 has been described as being driven with a predetermined air flow rate during the copying operation, the present invention is not restricted thereto.

When for example, the surface reverse portion 327 is provided with a sensor 335 (FIGS. 1A–1D) for detecting the presence or absence of the copy paper S and the copy paper S is present in the surface reverse portion 327, the copy paper S is in contact with the good heat conductive sheet 503 or the good heat conductive belt 507 and therefore, driving is effected with a predetermined air flow rate necessary for the cooling of the copy paper, and the copy paper. S is absent in the surface reverse portion 327, it is unnecessary to effect the cooling of the copy paper and therefore, the blowing fan may be driven with the air flow rate made lower than when the copy paper S is present, or control switching such as switching off the driving may be done.

If this control switching is done, the blowing fan 502 can be driven for a minimum necessary time conforming to a paper passing sequence, and the electric power consumption of the blowing fan can be reduced, and it becomes possible to provide an image forming apparatus 1 which is effective for energy saving.

Embodiment 7

While in Embodiments 1 to 6 the blowing fan 502 has been described as being driven with a predetermined air flow rate during the cooling of the copy paper, the present invention is not restricted thereto.

For example, a sensor 334 (FIGS. 1A–1D) for detecting the thickness of the copy paper S is provided in the image forming apparatus 1, and control switching such as increasing the air flow rate for thick paper higher in quantity of heat, and decreasing the air flow rate for thin paper lower in quantity of heat may be done on the basis of the detected information by the sensor 334.

If this control switching is done, the blowing fan 502 can be driven with a necessary minimum air flow rate conforming to the quantity of heat of the paper, and the electric power consumption of the blowing fan can be reduced, and it becomes possible to provide an image forming apparatus 1 which is effective for energy saving.

The sensor 334 detects the displacement of the surface reverse rollers 328 when the copy paper S passes between the surface reverse rollers 328, thereby detecting the thickness of the copy paper S.

According to Embodiments 1 to 7 described above, a good heat conductive thin-walled member for contacting with copy paper and absorbing heat, and a blowing fan for cooling the radiating portion of the good heat conductive thin-walled member by a space independent of the heat absorbing portion are provided in a transport route leading from a fixing roller again to an image forming portion in a two-sided copy mode, whereby without resulting in faulty transport due to the fluttering of the copy paper and the bulkiness of an image forming apparatus, and without causing a limit to the cooling capacity even for the image forming apparatus made high in speed or high in fixing temperature, the heat of duplex copy paper can be sufficiently cooled, and it becomes possible to prevent a faulty image and a faulty operation due to the temperature rise of a toner in a developing device and a cleaner in the two-sided copy mode.

Further, the control of switching the air flow rate by the blower fan when necessary or in conformity with a necessary quantity is done, whereby it becomes possible to drive the blower fan for a necessary minimum tune or an air flow rate conforming to the quantity of heat of the copy paper, and the electric power consumption of the fan is reduced and an effect for energy saving is obtained.

The use of the good heat conductive sheet 503 can make the image forming apparatus more compact than the use of the good heat conductive belt 507.

What is claimed is:

1. An image forming apparatus comprising an image forming portion for forming an image on copy paper fed thereto;

a fixing portion for heating and fixing the image formed on the copy paper by said image forming portion;

a transporting portion for transporting the copy paper on which the image has been fixed by said fixing portion;

at least one heat absorbing portion provided in said transporting portion for contacting with the copy paper and absorbing the heat of the copy paper; and at least one cooling portion for cooling said heat absorbing portion, wherein said transporting portion has a surface reverse portion for reversing a front side and a back side of the copy paper on which the image has been fixed by said fixing portion, and said heat absorbing portion absorbs the heat of the copy paper on said surface reverse portion.

2. An image forming apparatus according to claim 1, further comprising on said surface reverse portion a first pair of surface reverse rollers forwardly and reversely rotated, and a second pair of surface reverse rollers forwardly and reversely rotated in synchronism with said first pair of surface reverse rollers, said heat absorbing portion being disposed between said first pair of surface reverse rollers and said second pair of surface reverse rollers.

3. An image forming apparatus according to claim 1, further comprising a copy paper detecting portion for detecting the presence or absence of the copy paper on said surface reverse portion and the cooling capability of said cooling portion is controlled in conformity with information detected by said copy paper detecting portion.

4. An image forming apparatus according to claim 3, wherein when it is detected by said copy paper detecting portion that the copy paper is absent on said surface reverse portion, the cooling capability of said cooling portion is weakened as compared with a case where the copy paper is present on said surface reverse portion.

5. An image forming apparatus according to claim 3, wherein when it is detected by said copy paper detecting portion that the copy paper is absent on said surface reverse portion, the driving of said cooling portion is switched off.

6. An image forming apparatus comprising an image forming portion for forming an image on copy paper fed thereto;

a fixing portion for heating and fixing the image formed on the copy paper by said image forming portion;

a transporting portion for transporting the copy paper on which the image has been fixed by said fixing portion;

at least one heat absorbing portion provided in said transporting portion for contacting with the copy paper and absorbing the heat of the copy paper; and at least one cooling portion for cooling said heat absorbing portion, wherein said heat absorbing portion is a cut-sheet-shaped thin-walled member formed of a material excellent in heat conductivity and flexibility and having a heat absorbing end for contacting with the copy paper and a heat radiating end opposed to said heat absorbing end, and said cooling portion cools said heat radiating end.

7. An image forming apparatus according to claim 6, wherein said cut-sheet-shaped thin-walled member is formed with a plurality of slits in a direction orthogonal to the transport direction of the copy paper.

8. An image forming apparatus according to claim 6, wherein there is disposed a changeover portion for changing over the direction of inclination of said heat absorbing end with respect to the cut-sheet-shaped thin-walled member.

9. An image forming apparatus comprising an image forming portion for forming an image on copy paper fed thereto;

a fixing portion for heating and fixing the image formed on the copy paper by said image forming portion;

a transporting portion for transporting the copy paper on which the image has been fixed by said fixing portion;

at least one heat absorbing portion provided in said transporting portion for contacting with the copy paper and absorbing the heat of the copy paper;

at least one cooling portion for cooling said heat absorbing portion; and a paper thickness detecting portion for detecting the copy paper being transported, wherein the cooling capability of said cooling portion is controlled in conformity with paper thickness information detected by said paper thickness detecting portion.

10. An image forming apparatus according to claim 9, wherein when it is detected by said paper thickness detecting portion that the copy paper is thick paper, the cooling capability of said cooling portion is strengthened as compared with a case where thin paper is detected.

* * * * *

UNITED STATES PATENT AND TRADEMARK OFFICE

CERTIFICATE OF CORRECTION

PATENT NO. : 6,741,815 B1
DATED : May 25, 2004
INVENTOR(S) : Keiko Fujita et al.

It is certified that error appears in the above-identified patent and that said Letters Patent is hereby corrected as shown below:

Title page,
Item [56], References Cited, FOREIGN PATENT DOCUMENTS, "4-4260065" should read -- 4-260065 --.

Column 7,
Line 17, "widthwisely" should read -- widthwise --.

Signed and Sealed this

Seventh Day of September, 2004

JON W. DUDAS
*Director of the United States Patent and Trademark Office*

UNITED STATES PATENT AND TRADEMARK OFFICE

CERTIFICATE OF CORRECTION

PATENT NO. : 6,741,815 B1
DATED : May 25, 2004
INVENTOR(S) : Keiko Fujita et al.

It is certified that error appears in the above-identified patent and that said Letters Patent is hereby corrected as shown below:

Title page,
Item [56], References Cited, FOREIGN PATENT DOCUMENTS, "4-4260065" should read -- 4-260065 --.

Column 7,
Line 17, "widthwisely" should read -- widthwise --.

Signed and Sealed this

Fourteenth Day of September, 2004

JON W. DUDAS
*Director of the United States Patent and Trademark Office*